US005895306A

United States Patent [19]

Cunningham

[11] Patent Number: 5,895,306

[45] Date of Patent: Apr. 20, 1999

[54] POLYGONAL PUZZLE KIT CAPABLE OF THREE-DIMENSIONAL CONSTRUCTION, SUCH AS TOY CONSTRUCTION

[75] Inventor: Douglas Cunningham, North Harrow, United Kingdom

[73] Assignee: Seven Towns Limited, London, United Kingdom

[21] Appl. No.: 08/762,567

[22] Filed: Dec. 9, 1996

[30] Foreign Application Priority Data

| | | | |
|---|---|---|---|
| Jan. 10, 1996 | [GB] | United Kingdom | 9600443 |
| Feb. 16, 1996 | [GB] | United Kingdom | 9603360 |
| Mar. 25, 1996 | [GB] | United Kingdom | 9606212 |

[51] Int. Cl.[6] ..... A63H 33/08; A63H 3/16

[52] U.S. Cl. ..... 446/108; 446/102; 446/116; 446/120; 446/97

[58] Field of Search ..... 446/97, 102, 104, 446/109, 114, 115, 116, 120, 122; 273/155, 156; 52/589.1, 591.1, 592.1

[56] References Cited

U.S. PATENT DOCUMENTS

| | | | |
|---|---|---|---|
| 1,193,975 | 8/1916 | Beardsley . | |
| 1,292,188 | 1/1919 | Wheeler . | |
| 2,454,307 | 11/1948 | Cooley | 446/115 |
| 3,654,375 | 4/1972 | Geiger . | |
| 3,811,682 | 5/1974 | Neale et al. . | |
| 3,831,503 | 8/1974 | Tranquillitsky . | |
| 3,894,352 | 7/1975 | Hooker . | |
| 3,940,142 | 2/1976 | Hinz et al. . | |
| 3,971,156 | 7/1976 | Lamlee . | |
| 3,987,580 | 10/1976 | Ausnit . | |
| 4,055,019 | 10/1977 | Harvey . | |
| 4,142,321 | 3/1979 | Coppa . | |
| 4,227,334 | 10/1980 | Hooker . | |
| 4,257,207 | 3/1981 | Davis . | |
| 4,492,723 | 1/1985 | Chadwick, II . | |
| 4,509,930 | 4/1985 | Schweigert et al. . | |
| 4,620,842 | 11/1986 | Wang . | |
| 4,685,892 | 8/1987 | Gould et al. . | |
| 4,874,341 | 10/1989 | Ziegler . | |
| 5,400,918 | 3/1995 | Prodaniuk | 446/115 |

FOREIGN PATENT DOCUMENTS

| | | | |
|---|---|---|---|
| 702336 | 1/1965 | Canada | 446/120 |
| 109181 | 5/1984 | European Pat. Off. | 446/104 |
| 0 121 433 | 10/1984 | European Pat. Off. . | |
| 121433 | 10/1984 | European Pat. Off. | 446/115 |
| 1073919 | 1/1960 | Germany | 446/116 |
| 1 378 942 | 1/1975 | United Kingdom . | |
| 1 540 426 | 2/1979 | United Kingdom . | |
| 2 272 790 | 5/1994 | United Kingdom . | |

*Primary Examiner*—Robert A. Hafer
*Assistant Examiner*—Laura Fossum
*Attorney, Agent, or Firm*—Kolisch, Hartwell, Dickinson, McCormack & Heuser

[57] ABSTRACT

A toy construction kit, particularly a three-dimensional puzzle, including a plurality of generally regular polygonal construction elements that can be releasably assembled, through tab-and-slot, hinged interengagement, to form a toy construction. Each of the construction elements is formed from a resiliently flexible sheet of plastics material, for example, polypropylene. A single toy construction may include construction elements in regular polygonal shapes of triangles, squares, and pentagons with all of the sides of the elements having, the same length. The tab-receiving slots of the tab-and-slot engagement may be provided in flanges formed integrally with and projecting from the sides of the construction elements. Advantageously, a plastics hinge joining the tab to the side of one of the elements may be set back from the side of the element and joined thereto by short cut portions, the slot formed in the flange on the other element may be stood out from the side of the other element by a similar distance, and the ends of the slots may be arcuate to join the slot to the hinge. In the toy construction, the tab and flange will overlap their respective opposing elements on the same side of the joint.

10 Claims, 7 Drawing Sheets

Fig. 6B
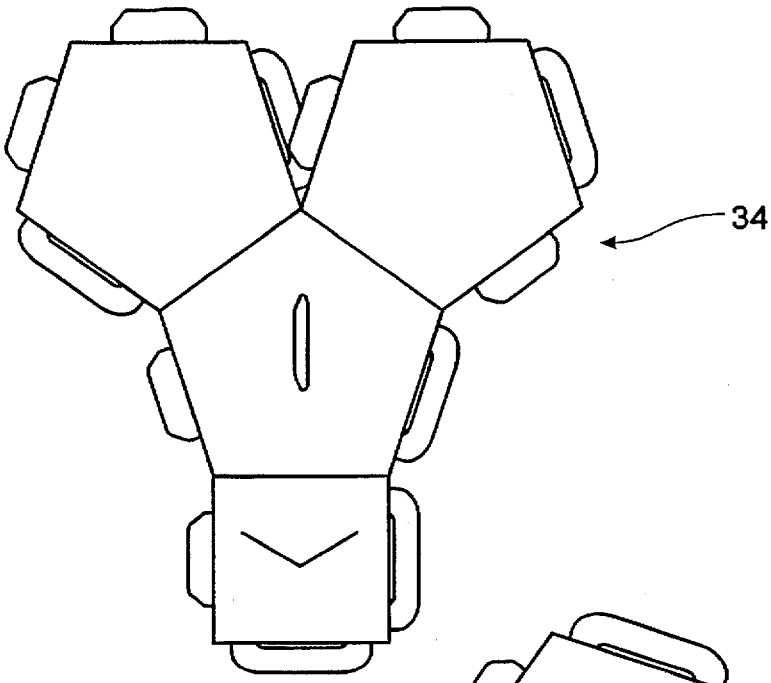
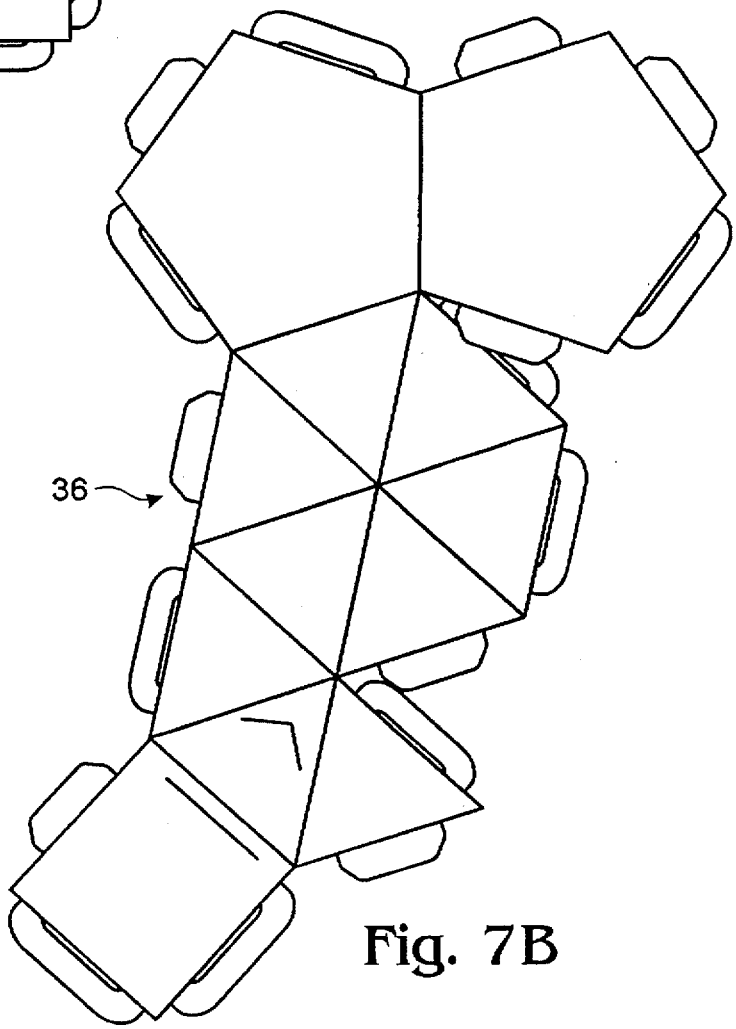
Fig. 7B

POLYGONAL PUZZLE KIT CAPABLE OF THREE-DIMENSIONAL CONSTRUCTION, SUCH AS TOY CONSTRUCTION

REFERENCE TO RELATED APPLICATIONS, AND INCORPORATIONS BY REFERENCE

This application claims priority from three prior-filed patent applications which were filed in the United Kingdom, and which are identified in the following manner: Application Ser. No. 9600443.7, filed Jan. 10, 1996; Application Ser. No. 9603360.0, filed Feb. 16, 1996; and Application Ser. No. 9606212.0, filed Mar. 25, 1996. The entire contents of these three prior-filed patent applications are hereby incorporated by reference into this application.

BACKGROUND AND SUMMARY OF THE INVENTION

The present invention relates to a novel polygonal puzzle kit including a plurality of reversibly interconnectable polygonal construction elements that can be releasably assembled to form one or more toy-like, or other three-dimensional, constructions. Assembly performed from the kit may result in a three-dimensional puzzle-like toy.

In the known, commercially available prior art, there exists a toy construction kit which is available under the trade mark "POLYDRON." This kit comprises a plurality of planar, rectilinear construction elements which are manufactured from high density polyethylene by an injection moulding process. The "POLYDRON" construction elements are several millimetres thick, and are therefore substantially rigid. The kit includes generally triangular, square and pentagonal construction elements, and the sides of these elements are all of the same length. The elements can be joined releasably to one another by means of snap-together hinges which can be formed between abutting sides of contiguous elements. To this end, each side of each construction element has a recessed portion and a protrusion which can be mated, respectively, with the protrusion and recessed portion formed in the juxtaposed side of a contiguous construction element. The contiguous elements are formed with engaging lugs and hollows respectively on the protrusions and in juxtaposition with the recessed portions, which lugs and hollows are disposed on straight lines which are parallel to the respective juxtaposed sides of the construction elements. The lugs on one of the sides of two contiguous elements snap-fit into the hollows on the other side, so as to hinge releasably the two elements together.

The "POLYDRON" construction kit has the disadvantage however that the releasable hinges which can be formed between contiguous elements are fragile, in the sense that they readily become disconnected if any twisting forces are applied across the hinges. In view of the rigidity of the individual construction elements, this means that only strictly rectilinear constructions can be made using the "POLYDRON" system, and any attempt to force the elements into an arrangement whereby twisting forces are applied across the hinges, will result in the construction collapsing.

Accordingly, it is an object of the present invention to provide an improved construction kit comprising a plurality of generally rectilinear construction elements which can be used to form non-rectilinear constructions in which twisting forces may be exerted across the joints between juxtaposed elements, without the constructions falling apart as a result of such twisting forces.

In one aspect of the present invention therefore there is provided a puzzle construction kit comprising a plurality of construction elements that can be releasably assembled to form a construction, each of which construction elements is formed from a resiliently flexible sheet of plastics material and comprises a substantially rectilinear shape, which shape is provided with a releasable hinging joining structure on one side and a cooperating structure on another side, which hinging joining structure can cooperate with the cooperating structure on another of the construction elements for releasably joining the construction elements one to another, and to form a flexible hinge therebetween.

The construction elements of the present invention generally have central panels with perimetral shapes that are triangular, square, pentagonal, hexagonal, or some other regular polygonal character. In their unjoined, unassembled form, each such element nominally is substantially planar, and the elements are constructed in such a manner that hinging joinder between adjacent elements can occur generally via coplanar approaching relative motion. The sides which define portions of the perimeter in each element are equal in length. These characteristics offer an important kind of "building-block" modularity which permits just about any two elements to be brought together for assembly. From a construction point of view, it makes no difference which of each element's two faces ends up facing the same way in the assembly as either face in the other element. From a surface-decoration point of view, however, this may not always be true.

Recognized, additionally, to be a potentially useful construction element, is one in which the central panel is, effectively, a double square (elongate rectangle).

The inherent flexibility of the construction elements in accordance with the present invention means that the construction elements can be used to form constructions in which some or all of the construction elements may be distorted from their natural, planar conditions, without applying forces across the hinges between juxtaposed elements such as to cause the hinges to fall apart.

In another aspect of the present invention there is provided a three-dimensional toy construction made from a plurality of construction elements in accordance with the present invention.

In yet another aspect of the invention, the hinging joining structure may comprise a tab which is formed integrally with the shape, and is connected thereto by a plastics hinge. The cooperating structure may define a slot adapted to receive the tab. The tab and slot may be shaped such that in the fitted position, the tab is releasably retained in the slot for forming the joint between the two sides of adjacent construction elements. The use of such tab and slot joining structure, also referred to herein as inter-element connector structure, between contiguous elements means that the joints can be subjected to a certain amount of strain without falling apart. This is advantageous because it allows constructions made in accordance with the invention to be played with as toys after assembly.

In still another aspect of the invention each side of each construction element may be provided with a tab or a slot, such that in some constructions made using such elements, each side of each element may be joined to a side of a contiguous element. The resulting construction will thus have a monocoque design which lends it further robustness and "playability".

While, as will be explained, specialized construction kits may be made in accordance with this invention—for example, kits designed to produce certain specific objects—with these kits having certain specialized construction elements, the fundamental or basic non specialized construction elements have what is referred to herein as undefined connective relationships to other elements. This undefined connectivity is a modularization scheme which allows just about any two elements to be brought together and readily joined. Also, the elements have a certain amount of interchangeability.

As will be well known to persons skilled in the art, a plastics hinge is capable of being flexed many thousands of times without damage. In some embodiments, the construction elements may be formed from polypropylene. The elements may for example be die-cut from a flat sheet of polypropylene, which may be an extruded sheet. Alternatively, the elements may be injection moulded. Other materials may, of course, be used.

Usually, the construction kit in accordance with the invention will comprise largely triangular, square and pentagonal construction elements, typically a plurality of each—the fundamental elements mentioned above. These elements can be combined to form, for example, the five platonic solids. The flexibility of the polypropylene sheet material, and the plastics hinges between contiguous elements, enables a wide variety of other rectilinear and non-rectilinear constructions to be made in accordance with the invention.

The thickness of each construction element will usually be less than about 1.0 mm, preferably 0.5–1.0 mm, and typically about 0.8 mm. The sides of the triangular, square and pentagonal elements may all be of the same length. This unit length will vary from kit to kit according to the desired use of the kit, but may be 40 to 50 mm for example. A smaller side length, e.g., 20 to 25 mm, may be used for forming more intricate three-dimensional constructions in accordance with the invention.

In some embodiments, the tab-receiving slots may be provided in flanges formed integrally with and projecting from the sides of the shapes. Advantageously, the plastics hinge joining the tab to the side of one of the elements may be set back from the side of the element and joined thereto by short cut portions, the slot formed in the flange on the other element may be stood out from the side of the other element by a similar distance, and the ends of the slots may be arcuate to join the slot to the hinge. In the construction, the tab and flange will overlap their respective opposing elements on the same side of the joint. The hinge formed between the two elements permits the two elements to be hinged relative to one another, thereby to allow the formation of three-dimensional articles. Interestingly, the tab/slot/hinge joining structure proposed by the present invention allows for a situation wherein joinder of any three or more elements offers the possibility, in a final construction, for such joined elements to lie selectively either in a state of coplanarity, or, alternatively, in either one of two mirror-image, noncoplanar "cupped" conditions. These dispositional opportunities will be explained a bit more fully at a later point in this specification.

In other embodiments, each tab may be formed with two lugs which are spaced apart in the direction of the juxtaposed construction element side, and the distance between the extremities of the lugs across the tab may be slightly greater than the width of the slots, so as to form a snap-fit between each tab and slot.

One advantage of using polypropylene for making the construction elements in accordance with the present invention is that polypropylene can be surface decorated, e.g., by litho-printing which allows the production of a surface decoration of photographic quality. Any such surface decoration may be protected by an ultraviolet fixed varnish.

In yet another aspect of the present invention therefore each of the construction elements of the kit may be decorated on at least one surface in a manner appropriate for a particular assembled construction. For example, in some embodiments, the construction may be a model animal, in which case the individual elements may be decorated in a manner appropriate for the colours and pattern of the skin or coat of the animal concerned.

Each of the construction elements may be decorated on both surfaces, and in such cases, the decorations on the two surfaces will usually be different from each other, such that the elements can be used to make two "transformable" constructions; that is to say that one construction made using the elements with one surface showing can be "transformed" by disassembly and subsequent different reassembly to make the same or a different construction with the other surface showing. The ability of several kinds of groupings of joined elements to occupy, selectively, either (a) conditions of coplanarity, or (b) conditions of two different mirror-image cupped configurations contributes greatly to such a reassembly possibility.

Of course, each of the construction elements of the same shape may be decorated with identical surface decorations such that the elements of the same kind, from a "decoration" point of view, are interchangeable with each other. In yet another aspect of the invention however, each construction element may have a unique surface decoration in the kit, such that the elements have to be assembled in a predetermined arrangement. The degree of decoration difference between contiguous elements in the construction can be varied so as to make assembly in the correct fashion either easier or more difficult. In this way, the kit of the invention may constitute a three-dimensional puzzle in the manner of, say, a jigsaw.

Computer modelling may be used for designing the surface decoration to be applied to the construction elements of the kit, so as to ensure that the decoration applied to the two-dimensional construction elements, usually before they are die-cut from the extruded sheet, gives a satisfactory visual result when the construction is made in three dimensions. The design applied to the elements may include visual clues for assembly of the elements in the correct arrangement as in a conventional two-dimensional jigsaw.

In yet another aspect of the present invention, the construction kit may comprise one or more special construction elements appropriate to the construction kit concerned. These special construction elements may comprise, for example, body parts of animals, e.g heads, legs and the like, which can be fastened to the assembled "basic" elements to finish a particular desired construction.

These and other objects and advantages which are attained by the invention will become more fully apparent as the following description is read in conjunction with the accompanying drawings.

DESCRIPTION OF THE DRAWINGS

FIG. 6B (Plate VI) shows a plurality of construction elements which are joined together to form a front part of the armadillo construction of FIG. 6A.

FIG. 7B (Plate VI) shows a plurality of construction elements which are joined together to form a rear part of the armadillo construction of FIG. 7A.

DETAILED DESCRIPTION OF THE INVENTION

Figure 1:
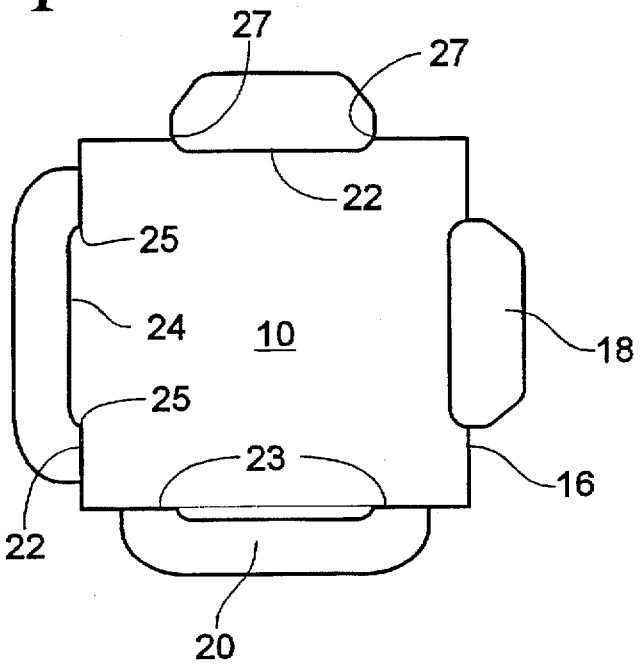
FIG. 1 (Plate I) shows a plan view of a square construction element forming part of a construction kit in accordance with the present invention.
Figure 2:
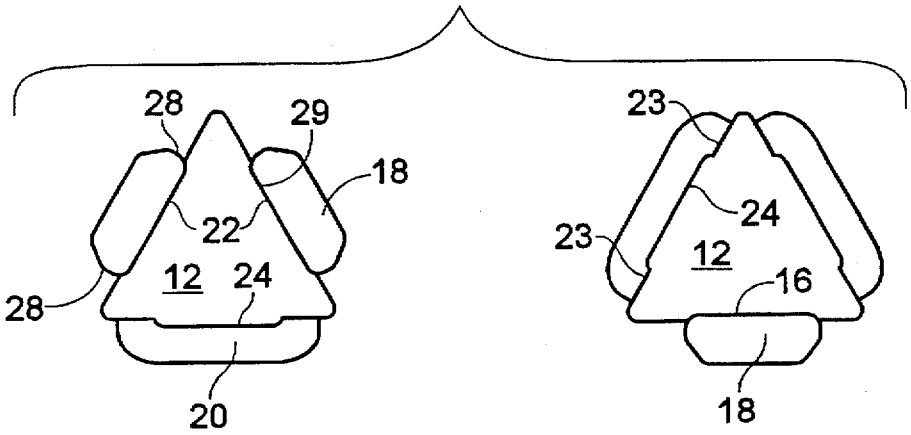
FIG. 2 (Plate II) shows in plan view two different triangular construction elements.
Figure 3:
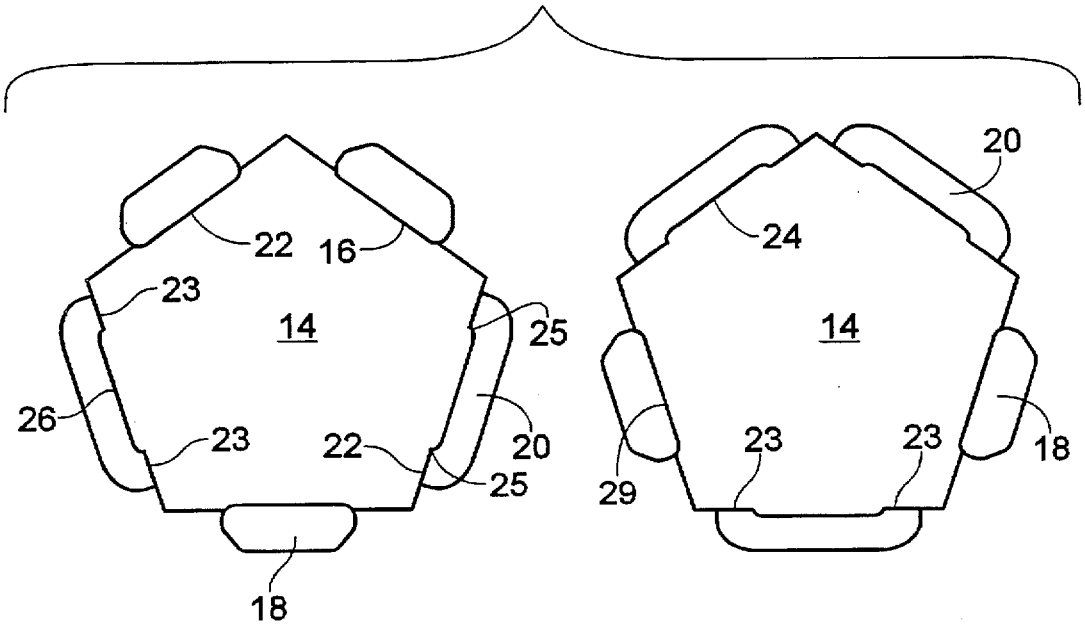
FIG. 3 (Plate II) shows in plan view two pentagonal construction elements.

A construction kit in accordance with the present invention comprises a plurality of flat, rectilinear construction elements which are manufactured by die-cutting preferably an extruded polypropylene sheet. The kit comprises generally square elements (10), as shown in FIG. 1, and also triangular elements (12) and pentagonal elements (14) as shown in FIGS. 2 and 3, respectively.

The terms "square", "triangular" and "pentagonal" just used in the preceding sentence relate to the generally planar central panels of the respective construction elements illustrated. These shapes are shapes of regular polygons, and while specifically only three different shapes in this category are illustrated in the drawings, one should recognize that other kinds of construction elements having other kinds of regular polygonal central panels could be used in certain kit applications.

Alternatively, the construction elements (10,12,14) may be manufactured by injection moulding. The thickness of the elements is approximately 0.7 mm to 0.8 mm, such that each element is resiliently flexible. Other thicknesses of sheet may be used up to about 1 mm, provided that the elements remain robust and not susceptible to tearing, and also remain flexible.

The sides (16) of the square, triangular and pentagonal construction elements (10,12,14) are all of the same (or unit) length, and each side (16) is equipped with a tab (18) or a slotted flange (20). Usually, a square construction element (10) in accordance with the invention will comprise two tabs (18) and two slotted flanges (20), although it will be appreciated that in some instances, square construction elements comprising four tabs (18) or four slotted flanges (20) may be provided. Similarly, the triangular construction elements (12) will each usually have two tabs (18) and one slotted flange (20) or two slotted flanges (20) and one tab (18) as shown in FIG. 2. The pentagonal construction elements will usually each have two or three tabs (18) and three or two slotted flanges (20) as shown in FIG. 3.

The tabs (18) and slotted flanges (20) on the sides (16) of the construction elements (10,12,14) provide structure for joining adjacent construction elements together in assemblies ultimately to form a construction such as those which are shown in FIGS. 5, 6 and 7. It will be appreciated that, except to the extent that surface decoration coherence dictates, likeshaped elements may be used interchangeably.

The tabs (18) and slotted flanges (20) are formed integrally with the construction elements, and each tab (18) and slotted flange (20) is joined to its respective construction element by means of a plastics hinge (22). Plastics hinges are well known to persons skilled in the art, and are formed in polypropylene sheet material of the kind used to form the construction element described herein by using a pressing tool which orients the polymers juxtaposed the hinge. The result is that the plastics hinge (22) can be flexed many thousands of times without breaking or tearing.

In the case of the slotted tabs (20), it will be seen that the plastics hinge (22) comprises two hinge portions (23) disposed collinearly either side of the slot (24). It will be seen from FIGS. 1, 2 and 3 that the hinge portions (23) are formed along the line of the juxtaposed side (16), while the slot (24) is formed parallel to the side (16) and spaced therefrom by a short distance. The slot (24) is formed with arcuate end portions (25) which meet the hinge portions (23) so as to define a protruding portion (26) which protrudes slightly outwardly from the side (16) of the construction element (10,12,14). The plastics hinge (22) permits the flange (20) to be moved out of the plane of the construction element (10,12,14), while the protruding portion (26) remains that plane.

In the case of the tabs (18), the plastics hinge (22) is formed parallel with the juxtaposed side (16) of the construction element (10,12,14) and is set back therefrom by a short distance. Small cuts (27) are formed in the construction element (10,12,14) between the ends of the plastics hinge (22) and the side (16) of the element as shown in FIGS. 1, 2 and 3, so as to permit the tab (18) to be moved out of the plane of the construction element (10,12,14) along the plastics hinge line.

Each tab (18) is formed with two spaced lugs (28) at opposite ends of the tab in the direction of the juxtaposed side (16). The distance between the extremities of the lugs (28) is slightly greater than the width of the slots (24) formed in the slotted flanges (20).

In order to join two construction elements (10,12,14) together, a tab (18) on one of the elements is preferably coplanarly inserted through the slot (24) on the other element until the lugs (28) engage the flange (20) at either end of the slot (24). It will be apparent, as just suggested, that such joinder can conveniently be accomplished by moving the two elements toward one another in a generally common plane which is the same as the plane occupied by each element. By exerting further pressure to push the tab (18) through the slot (24), the lugs (28) and the slot (24) resiliently deform slightly, so as to allow the lugs to snap into place on the other side of the flange (20). This procedure can be reversed to separate the two construction elements. In the fitted position, the tab (18) of the one element, and the slotted flange (20) of the other element overlap their respective opposing construction elements on the same side of the joint. The plastics hinges (22) on the tab (18) and slotted flange (20) forming the joint allow the two joined construction elements to be hinged relative to one another along the line of the joint to include the overlapping tab (18) and slotted flange (20). The protruding portion (26) juxtaposed the slotted flange (20) forming the joint is received in a recess (29) defined by the plastics hinge (22) on the tab (18) and the two small cut portions (27) connected therewith. This overlap of the two joined construction elements means that the two opposing sides of the construction elements are disposed in close proximity at the joint.

Figure 4:
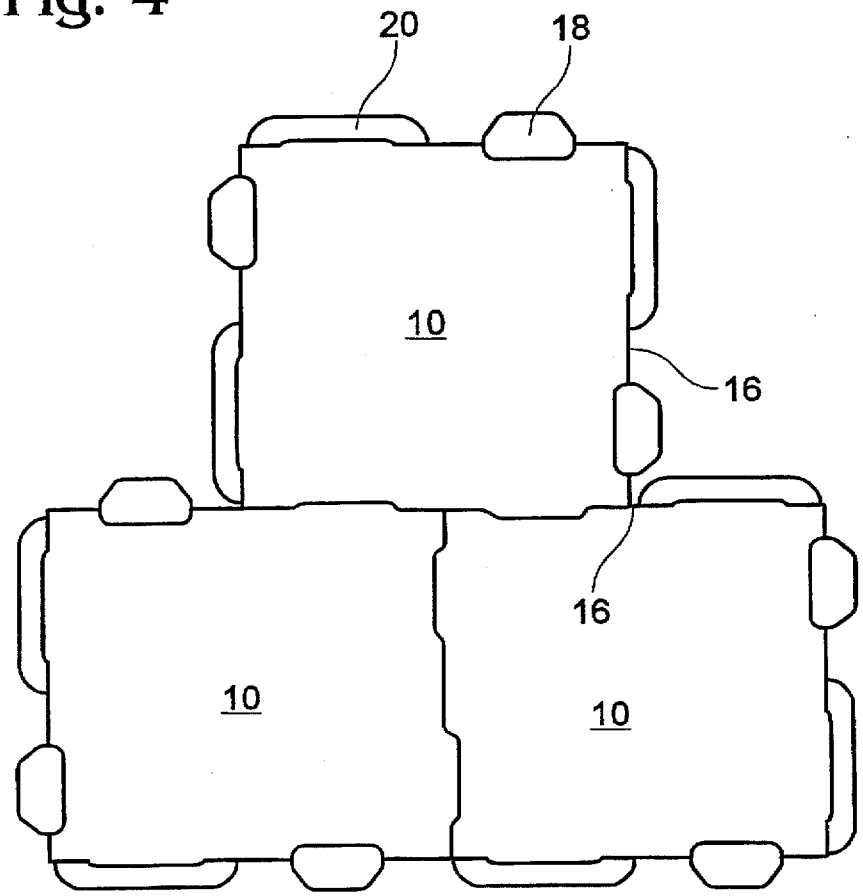
FIG. 4 (Plate I) shows three different square construction elements which are joined together in accordance with the present invention.

In some embodiments, each side (16) of each construction element may be formed with a slotted flange (20) and a tab (18) as shown in FIG. 4. This enables each side (16) of the construction element (10,12,14) to be joined to two juxtaposed construction elements (10,12,14) in a staggered manner as shown in FIG. 4. In yet another alternative which is not shown in the Figures, construction elements may be provided in which one or more sides (16) are an integer number of times unit length, and each unit length of such sides may comprise a tab (18) or a slotted flange (20). Thus, for example, rectangular construction elements may be provided having two sides of unit length and two sides of two units length or more.

The construction elements (10,12,14) can therefore be joined to one another in the manner hereinbefore described to form a construction such, for example, as the armadillo construction which is shown in FIGS. 5, 6 and 7. It will be appreciated that many different constructions can be made using the construction elements (10,12,14) in accordance with the present invention, but the armadillo construction hereinafter described is given for the purposes of illustration.

The tab and slot (18,20) joining structure as hereinbefore described provides a hinging joint between contiguous elements (10,12,14) that is sufficiently robust to withstand a certain amount of strain across the joint without the elements separating from one another. The resulting construction (30) is therefore strong enough to be played with as a toy. It will be understood that some constructions (30) may be formed in which each side (16) of each element (10,12,14) is joined to a side of a contiguous element to form a continuous surface. Such constructions may have a monocoque design which lends additional strength and thus "playability".

Figure 5A:
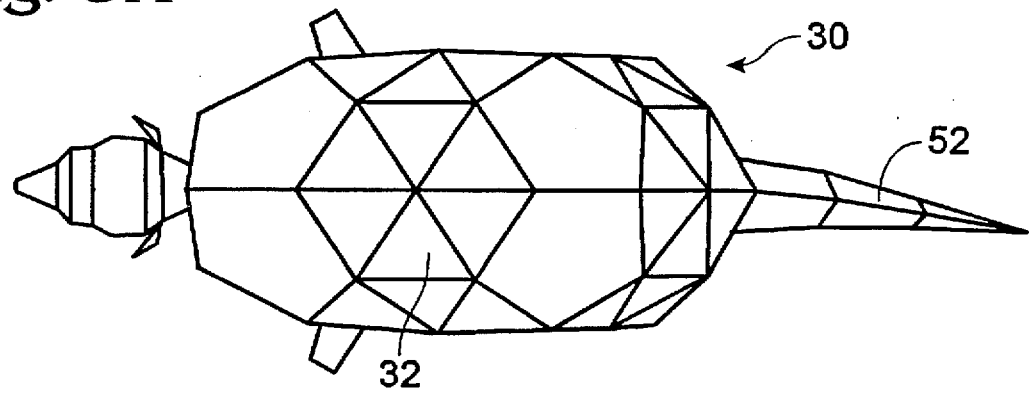
FIGS. 5A, 5B and 5C (Plate III) show in plan, side elevation and from underneath, respectively, an armadillo construction in accordance with the present invention.
Figure 5B:
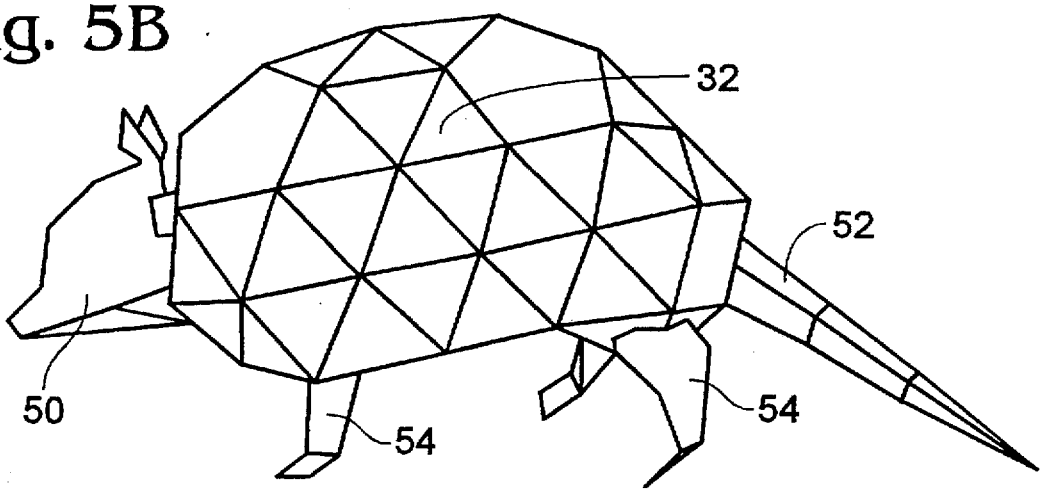
Figure 5C:
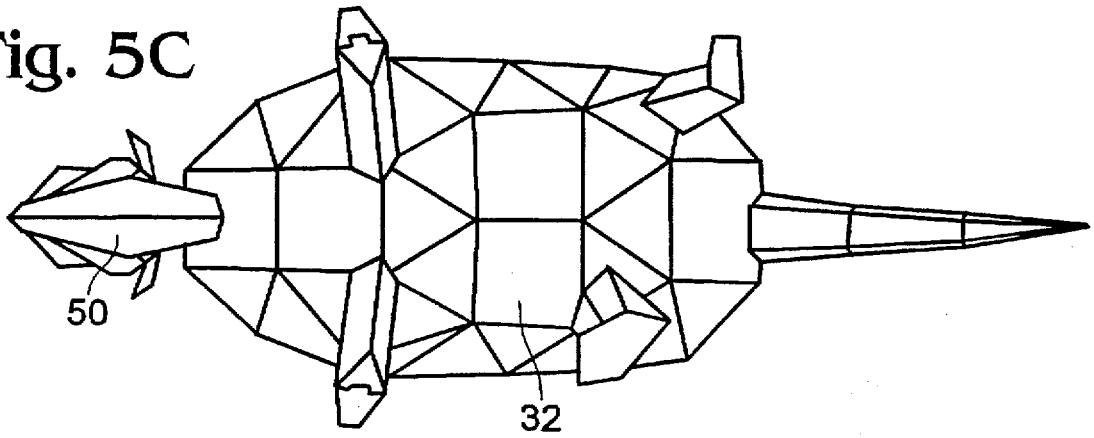

Generally, the construction, such as the armadillo construction (30), will most easily be constructed from a plurality of separate assemblies of construction elements, which assemblies can be assembled flat, and joined to one another to form the completed construction (30). In the example of the armadillo construction (30), FIGS. 5A, 5B and 5C, FIG. 6A, FIG. 7A and FIG. 8A show five such assemblies of construction elements which are identified by reference numerals (32,34,36,38,40) respectively. These assemblies are shown in their assembled flat conditions in FIGS. 5D, 6B, 7B, 8B and 8C respectively. The strip (32) as shown in Figure SD is constructed from twenty-four triangular construction elements (12) and two square construction elements (10). It will be seen that eighteen of the triangular construction elements (12) are used to form three contiguous hexagonal assemblies (42). The two square construction elements (10) can be joined to one another as shown in FIG. 5C to form the loopshaped middle part (32) of the armadillo construction (30).

Figure 5D:
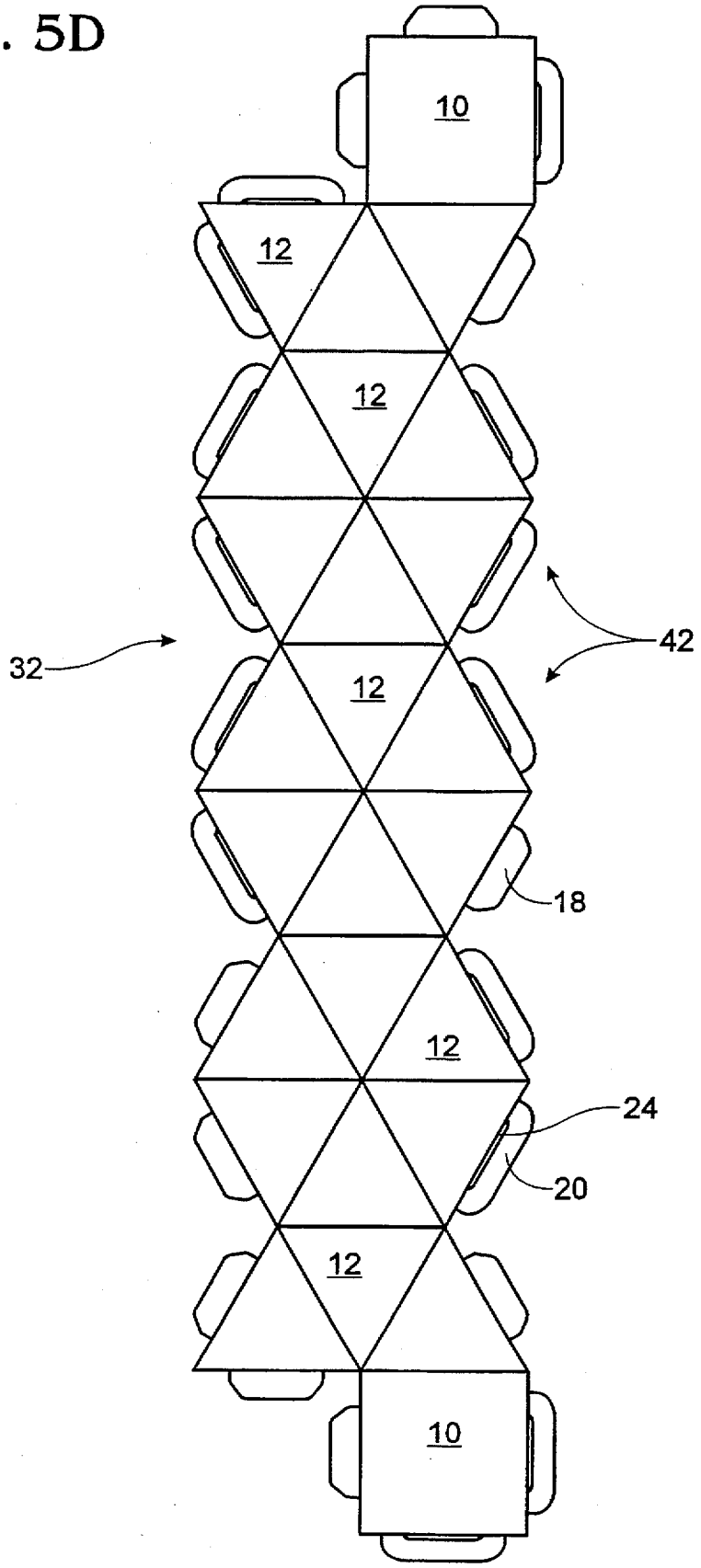
FIG. 5D (Plate IV) shows a plurality of construction elements in accordance with the present invention which are joined together to form a strip which can be used to form a middle part of the armadillo construction shown in FIGS. 5A, 5B and 5C.

Noting here a few more very interesting features of the present invention, the assembly which is illustrated in FIG. 5D includes multiple assembled elements which are all lying in a common plane. Focusing attention on each of the three hexagonal sub-assemblies (42), the hinging/joining structure proposed by the present invention allows this particular kind of six-piece assembly, i.e., an assembly which includes more than three construction elements, either to end up (in a final construction) as one having a planar configuration, or as one having either one of two, different, mirror-image, "cupped" configurations. For example, if we assume that the side of a sub-assembly (42) which is visible to the viewer in FIG. 5D ends up facing outwardly in the armadillo structure illustrated in FIGS. 5A, 5B, 5C, one will observe that each such hexagonal sub-assembly will end up distorted out of plane to have a cupped configuration with what can be thought of as the convex side of the "cup" facing outwardly. Had a reverse choice of orientation been selected, whereby the under, non-visible side of the assembly pictured in FIG. 5D were chosen to be the outwardly facing side in the armadillo construction, these very same hexagonal sub-assembly units (42) would have the just-referred-to mirror-image cupped shape.

It will thus be apparent that different groupings of three contiguously joined construction elements, depending upon the way that they are hinged and bent during a construction assembly procedure, might end up lying selectively either in a common plane or in either one of two mirror-image cupped conditions. This interesting feature of the present invention, which promotes a great deal of creative versatility in the ways that constructions can be formed, is uniquely supported and promoted by the special slot and tab hinging joinder structure proposed herein.

Figure 6A:
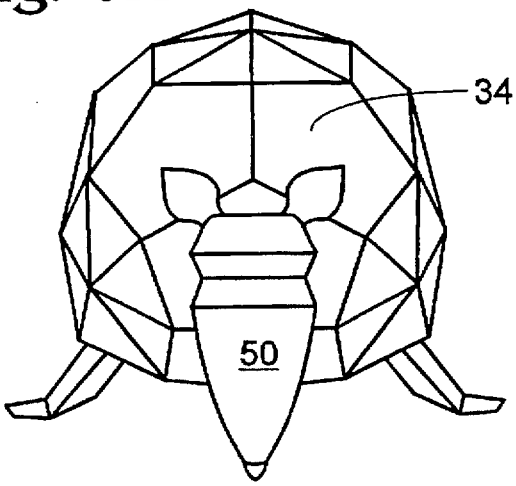
FIG. 6A (Plate V) is a front elevation of the armadillo construction of FIGS. 5A to 5C.
Figure 7A:
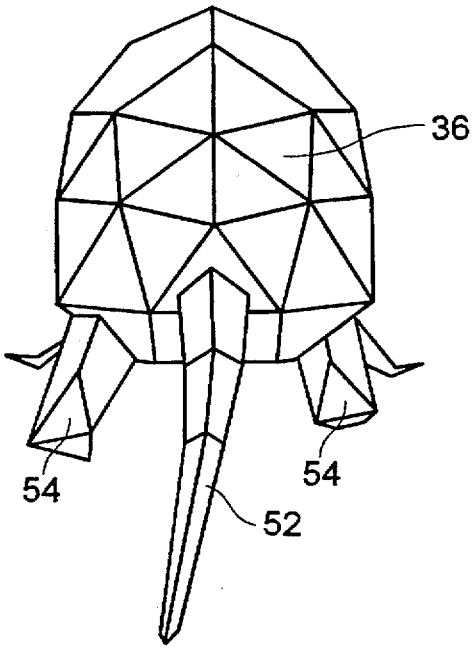
FIG. 7A (Plate V) shows the armadillo construction of FIG. 6A in rear elevation.

Returning to details of the armadillo construction, the front and rear end parts (34,36) as shown in FIGS. 6A and 7A are formed by two flat assemblies shown in FIGS. 6B and 7B, which assemblies comprise, respectively, three pentagonal construction elements and one square element (FIG. 6B), and two pentagonal elements, nine triangular elements and one square element (FIG. 7B). The front and rear end parts (34,36) are joined to the completed loop-shaped middle part (32) as shown in FIGS. 6A and 7A.

Figure 8A:
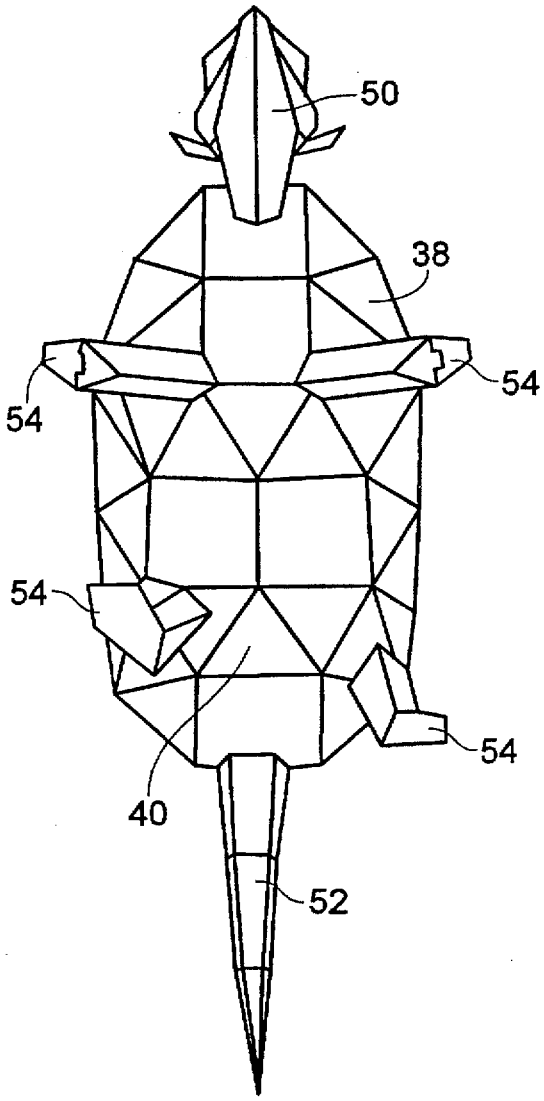
FIG. 8A (Plate VII) shows the armadillo construction of FIGS. 5A to 5C, 6A and 7A from underneath.
Figure 8B:
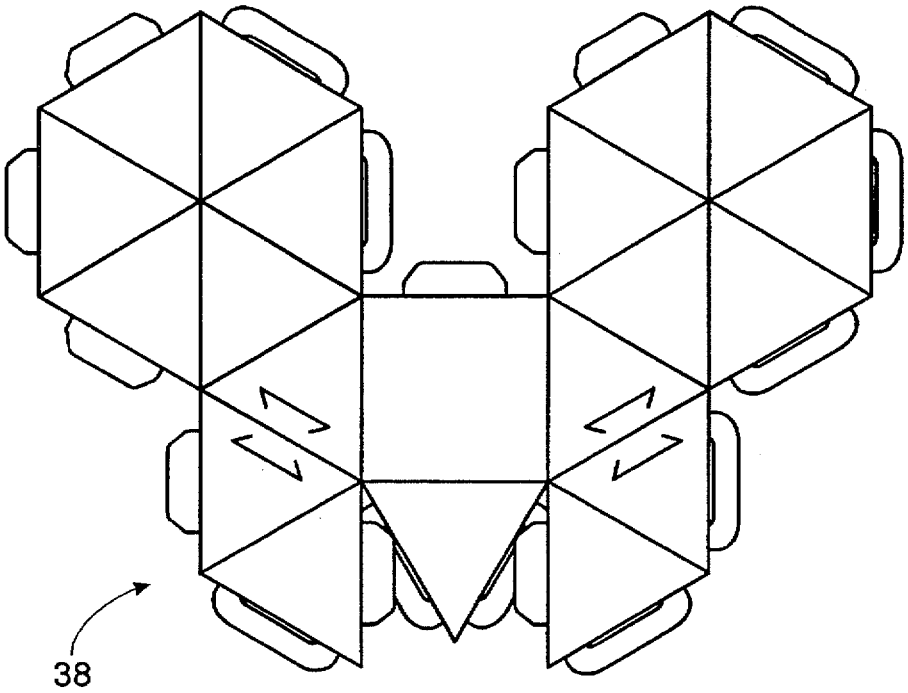
FIGS. 8B and 8C (Plate VIII) show, respectively, a front quarter part and a rear quarter part of the armadillo construction of FIG. 8A, each of which front and rear quarter parts comprises a plurality of construction elements which are joined to one another.
Figure 8C:
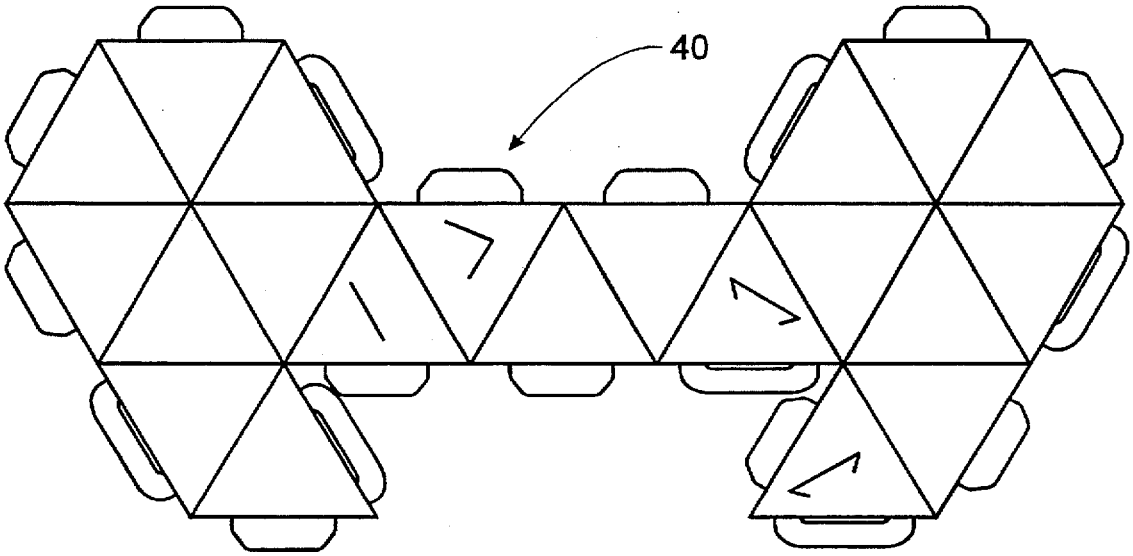

Front and rear quarter parts (38,40) respectively are made flat as shown in FIGS. 8B and 8C, and are then joined to the middle part and front and rear parts as shown in FIG. 8A to form the completed body of the armadillo construction (30).

The armadillo construction (30) is completed by fitting specially manufactured head (50), tail (52) and leg (54) construction elements. Each of these special construction elements (50,52,54) is die-cut from an extruded polypropylene sheet in the same way as the basic triangular, square and pentagonal construction elements (10,12,14), and each is fitted with fold lines, tabs and slotted flanges (18,20) as appropriate, such that the special construction elements can be folded into a three-dimensional configuration, and fastened in such configuration using the tabs and slotted flanges in the manner hereinbefore described. The special construction elements in their three-dimensional configurations can then be fitted to the completed armadillo construction (30) by means of appropriately positioned slots formed in selected basic construction elements (10,12,14) in the front and rear parts (34,36) and front and rear quarter parts (38,40), and by means of tabs formed on the special construction elements (50,52,54) for this purpose.

The basic and special construction elements (10,12,14, 50,52,54) may each be decorated on one surface which faces outwardly in the finished armadillo construction (30). The surface decoration may be formed for example by lithoprinting and protected by an ultraviolet fixed varnish. The surface decoration may be such as to represent a real-life armadillo, or may alternatively be any selected bright colours arranged in an attractive pattern as appropriate for a child's toy.

Alternatively, each construction element (10,12,14) may be decorated on both surfaces, and the two surface decorations may be different, so that the armadillo (30) can be made with either one group of surfaces or the other facing outwardly to present two alternative overall appearances, e.g., one "realistic" to an armadillo, and one fantastic. Modular reversibility and interchangeability enhance this intriguing possibility.

The basic construction elements (10,12,14) may be finished with identical or different decorations. In the latter case, the construction (30) will be more challenging to assemble in the manner of a puzzle or 3-D jigsaw. Each element (10,12,14) may, for example, be printed on one surface with a unique surface decoration such that the elements can be assembled in a unique arrangement to form a three-dimensional construction having a predetermined, coherent surface design. The decoration on each element may be designed to contain visual clues as to how the elements are to be assembled to form the predetermined design. Optionally, each element may also be provided, e.g., by printing on its other surface, with a unique identifying code reference, such as a numeral or letter. The kit may include a separate key which discloses to a player who is "stuck" how to assemble the elements in the correct order by reference to the code references.

Thus, a preferred embodiment of the present invention, and certain modifications thereof, have been described and/or illustrated hereinabove. Other variations and modifications may also be made which come within the scope of the present invention.

It is claimed and desired to secure by Letters Patent:

1. A toy construction kit providing a threedimensional puzzle, the kit comprising a plurality of construction elements configured to be releasably assembled in both a modular and an interchangeable manner to form a construction, each of the construction elements being formed from a resiliently flexible sheet of plastics material, and each of the construction elements comprising a substantially rectilinear shape generally in the form of a polygon, which shape is provided with a tab formed integrally with the shape on one side of the shape and which is connected thereto by a plastics hinge and a slot adapted to receive the tab and formed on another side of the shape, which tab is configured to cooperate with the slot on another of the construction elements for releasably joining the construction elements one to another in a fitted position, and to form a flexible hinge at a joint therebetween, the tab and slot being shaped such that, in the fitted position, the tab is releasably retained in the slot for forming the joint between the two sides of adjacent construction elements, wherein the tab-receiving slots are formed in flanges which are formed integrally with, and which project from, the sides of the shapes, and wherein the plastics hinges joining the tabs to the elements are each set back from their respective side, and wherein the slots formed in the flanges each stood out from their respective side by a similar distance and the flanged side includes a protruding portion which, in the fitted position, overlaps the side of the adjacent construction element.

2. A construction kit as claimed in claim 1, wherein one or both surfaces of each element is decorated, as by lithoprinting.

3. A construction kit as claimed in claim 2, wherein one or both surfaces of each element is protected by an ultraviolet fixed varnish.

4. The construction kit of claims 1, 2, or 3, wherein each construction element carries on one surface a unique surface decoration and the construction elements can be assembled in a unique arrangement to form a three-dimensional construction having a coherent predetermined surface design.

5. The construction kit of claim 4, wherein each element is provided on its other surface with a unique identifying code reference, and the kit further comprises a separate key which discloses, by reference to the unique code references on the elements, how the elements are to be assembled to make the predetermined design.

6. The construction kit of claims 1, 2, or 3, wherein the thickness of each construction element is less than about 1-mm.

7. The construction kit of claim 6, wherein the thickness of each construction element is between about 0.7-mm and about 0.8-mm.

8. The construction kit of claims 1, 2, or 3 which further comprises one or more special construction elements appropriate to the construction kit concerned which can be fastened to the assembled basic construction elements to finish a particular design construction.

9. A puzzle construction kit for building three-dimensional structures comprising:

a plurality of releasably coupleable construction elements, each element including a central, generally planar panel in the shape of a regular polygon defined by a plurality of sides, each of said sides of each of said elements in the construction kit having the same length;

at least one slot extending adjacent and partially along one of said sides of the panel; and at least one slot-engageable tab projecting in a hinged fashion from another of said sides in the panel, and connected thereto by a plastics hinge which is set back from said another of said sides in the plane of the panel, said slot-engageable tab nominally lying in the plane of the panel, and constructed to be slidably, reversibly, snap-engageable with one of said slots of another one of said plurality of construction elements in the construction kit, thereby joining said construction elements in close adjacency and for relative, bidirectional hinging motion at an elongate joint defined by the plastics hinge, said plurality of construction elements configured such that the joinder of any three or more of said elements lies selectively either in coplanarity, mirror-image, or non-coplanar cupped conditions.

10. A puzzle/construction kit comprising:

a plurality of modular, generally planar construction elements including rectilinear central panels in the shape of regular polygons defined by edges and opposed faces and with edge-joined connector structures defined by interconnectable tabs and slots formed on said edges of said central panel, wherein each element has at least one of said tabs, said tabs being joined to said central panels adjacent the edges with plastics hinges, said plastics hinges being set back from their respective edges, and wherein each element has at least one of said slots, each of said slots being formed at a protruding portion of one of the edges, the configuration of the tabs and slots such that, when one of said tabs of a first one of said construction elements is fitted into one of said slots of a second adjacent one of said construction elements, the protruding portion of said second adjacent one of said construction elements overlaps the edge of said first one of said construction elements, each of said construction elements being configured to be releasably and generally coplanarly connected, adjacent one of said edges, to form an assembly with other of said construction elements by inserting said tabs of said construction elements, into said slots formed in either of said opposed faces of other of said construction elements, said construction elements thereby capable of reversibly joining other of said construction elements, and configured to form a three-dimensional puzzle which can be assembled with substantially all sides of substantially all elements joined to a side of a contiguous element to form a continuous surface.

* * * * *